United States Patent [19]

Roberts

[11] Patent Number: 4,981,063

[45] Date of Patent: Jan. 1, 1991

[54] GUITAR

[76] Inventor: Curt P. Roberts, P.O. Box 5643, Diamond Bar, Calif. 91765-2378

[21] Appl. No.: 170,862

[22] Filed: Mar. 21, 1988

[51] Int. Cl.[5] ..... G10D 1/08

[52] U.S. Cl. ..... 84/267

[58] Field of Search ..... 84/263, 267, 327

[56] References Cited

U.S. PATENT DOCUMENTS

| | | | |
|---|---|---|---|
| 2,488,646 | 11/1949 | Suite | 84/267 |
| 2,550,176 | 4/1951 | Vitovsky | 84/267 X |
| 4,343,217 | 8/1982 | Brody | 84/263 |
| 4,715,259 | 12/1987 | Wittman | 84/327 |

*Primary Examiner*—Brian W. Brown

[57] ABSTRACT

The invention disclosed is a rotating portable guitar system made of a multifaced neck body rotatably mounted between two clear plastic discs attached at each end of the neck body. A regular shoulder strap is connected at each end to one of the two discs for holding the discs stationary relative to the neck body for allowing the neck body to be rotatable therebetween. The rotatable guitar includes push/pull knobs mounted at one end of the neck body for turning the guitar on and off. The guitar is rotatably free wheeling between the discs by manually rotating it from one face to another.

1 Claim, 5 Drawing Sheets

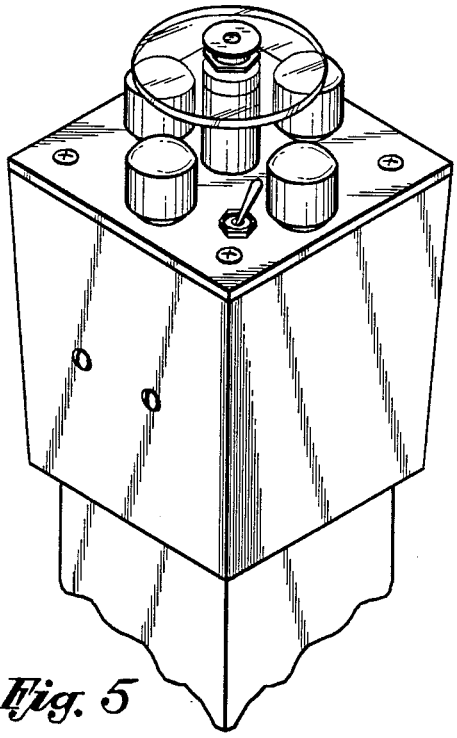
Fig. 5
Fig. 6
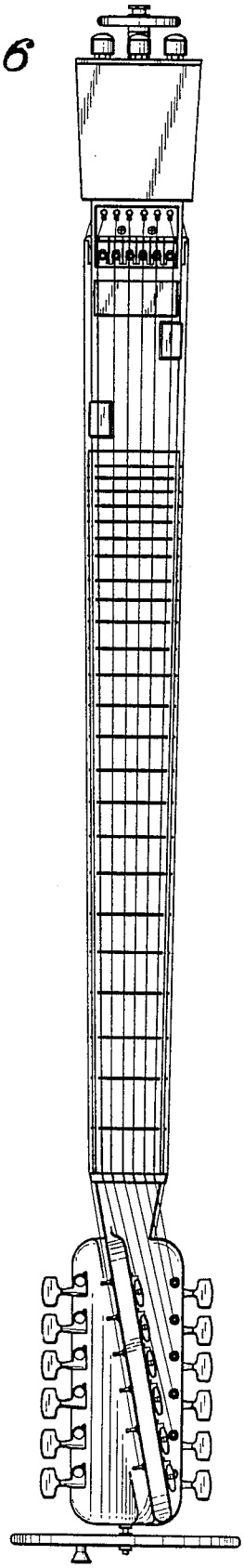

Fig. 9
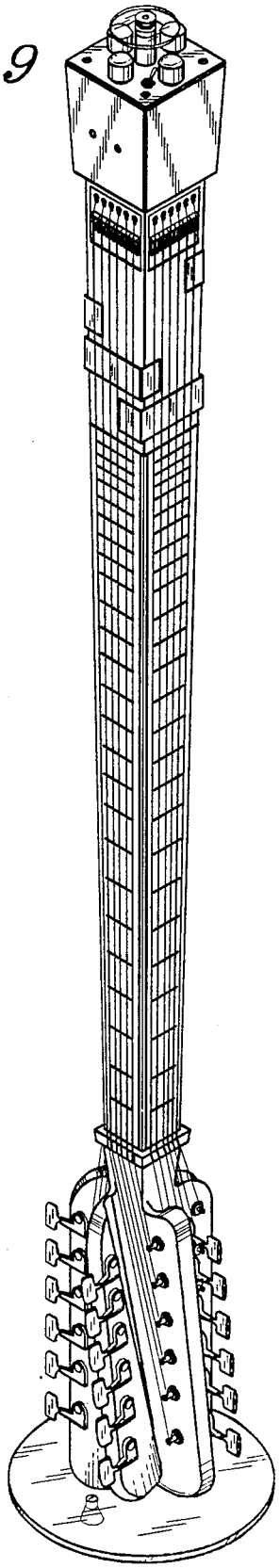
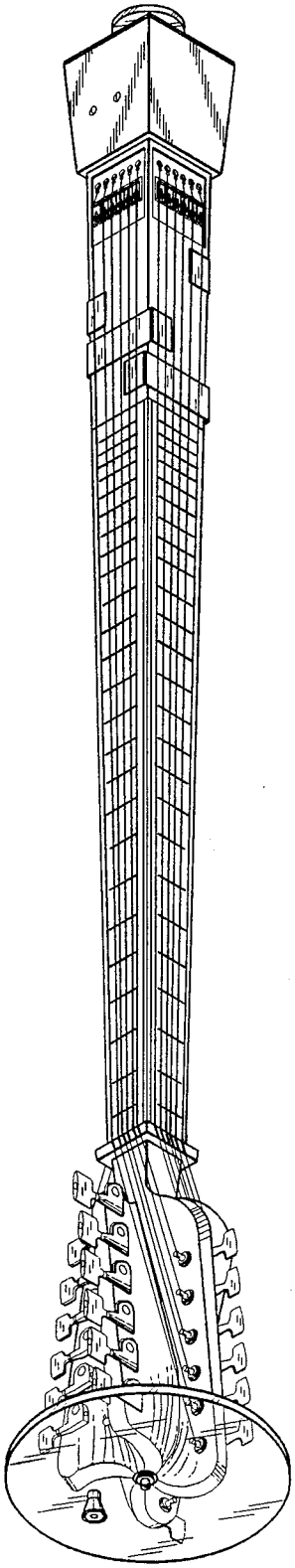
Fig. 10

GUITAR

BACKGROUND OF THE INVENTION a. Field of Invention—Electric steel guitars

This guitar is free wheeling, not case mounted and rotates to multi-faceted sides by manually turning it or rotating it between two clear plastic disc pins mounted on each end.

b. J.D. Suite and W.F. Vitovsky (both of the prior art guitar inventions) have the necks of the guitars mounted in a case. The R.P.G.S. is a free wheeling rotating guitar—not mounted in a case.

c. Brody 4.343.217 8/82

A standard 12 string, 6 string double neck guitar but with two guitar necks facing opposite directions to ultimately rotate to opposing 6 or 12 string side where as the R.P.G.S. is a multidimensional format with 4 guitars on one portable 4 sided guitar rotating unit.

d. Whittman 4,715,259, 12/29/87

The Whittman devise takes a regular guitar with a standard neck (not multi-dimensional as the unique R.P.G.S.) and lets the unit rotate in a clock wise rotation. The R.P.G.S. rotates backwards and forewards manually by hand turning it to 1 of 4 different guitars on one portable unit.

DESIGN AND BACKGROUND OF ROTATING PORTIBAL GUITAR SYSTEM

All electric guitars and acoustic guitars, since the beginning of time have been one d mensional, on a flat or slightly curved plane (neck( with 6–12 on it. Leo Fender and Les Paul, in the early 1950's developed magnetic pick-ups to electrify their guitars; known as Fender and Gibson guitars commercially.

The R.P.G.S. is the only mult-dimensional necked guitar in the world. The R.P.G.S. four-six string guitars are on a square neck with four sides and a guitar on each side. The R.P.G.S. can be played in any combination (6,12,18,24) or all guitars at once. The R.P.G.S. 12 string and 18 string (½ or ¾'s of original guitar) prototypes were designed from and after original guitar architecture was finished and should be protected under R.P.G.S. because they came from original design. Only on R.P.G.S. can one, two, three, or four necks be on at once. All guitars can be on separately or in any combination and in any tuning. By tuning the guitars differently and by turning the guitars so both A and B guitars are exposed to the front dual chords are possible by thumb chords on neck A and regular chords on neck B. A polyphonic chord on chord is achieved by playing both chords at the same time. All guitars can be tuned differently foropen tuned playing and abstract chords. No other guitars have the possibilities of these playing styles, because they do not have multi-dimensional necks and are built with flat or slightly curved necks for 6–12 strings on same surface. The R.P.G.S. is designed to play two, 3, or four guitars at the same time.

BRIEF DESCRIPTION OF THE DRAWINGS

FIG. 5 is an enlarged fragmentary, top perspective view of an end of the neck body of the guitar of the present invention having operational knobs, connection jack, and clear plastic disc.

FIG. 6 shows a right sided, elevational view of an other embodiment of the present invention.

FIG. 9 is a bottom perspective view of the guitar of the present invention.

FIG. 10 is a top perspective view of the guitar of the present invention.

Figure 1:
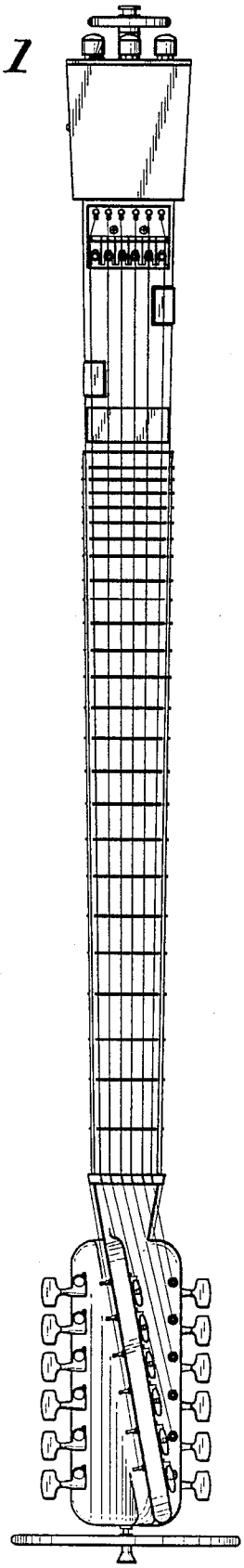
FIG. 1 shows a front elevational view of a first embodiment of a guitar of the present invention.
Figure 2:
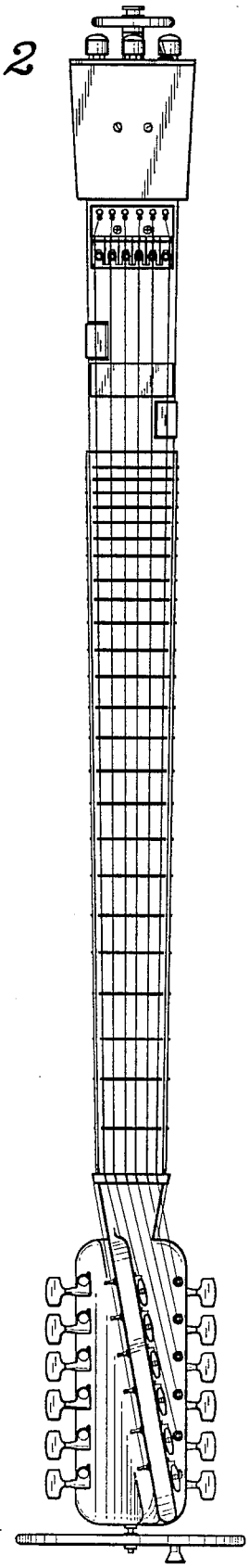
FIG. 2 shows a left sided elevational view of the guitar shown in FIG. 1.
Figure 3:
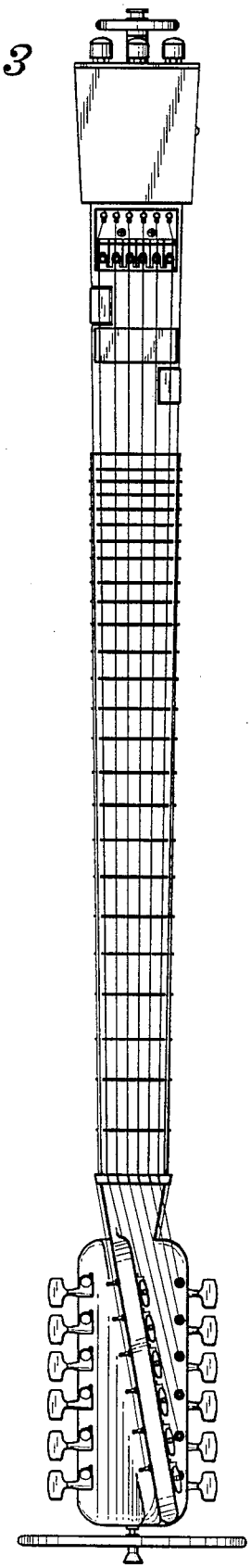
FIG. 3 shows a rear elevational view of the guitar shown in FIG. 1.
Figure 4:
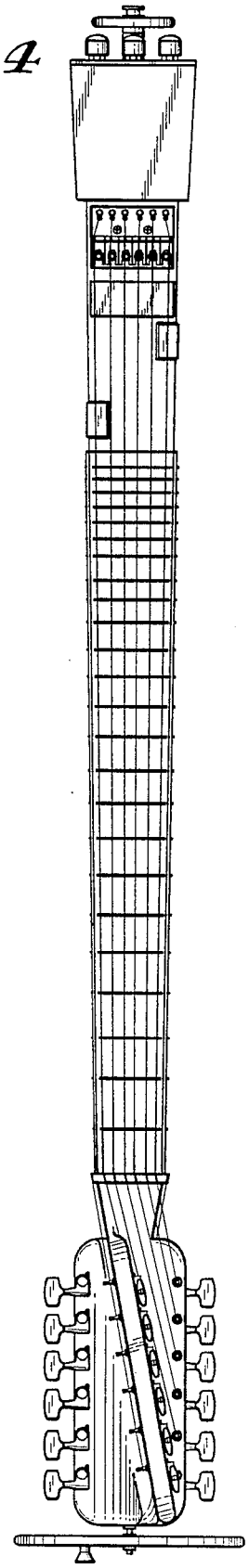
FIG. 4 shows a right sided elevational view of the guitar shown in FIG. 1.
Figure 7:
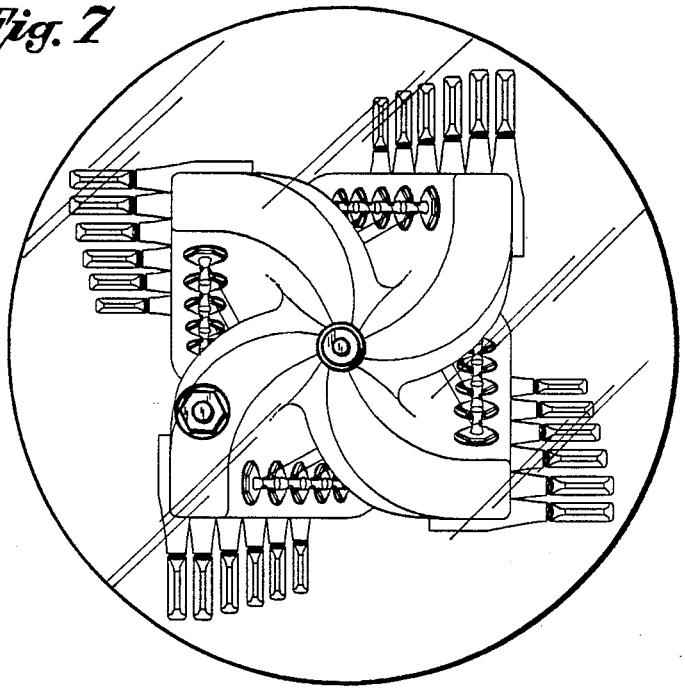
FIG. 7 shows an enlarged, top view of a head stock of the present invention.
Figure 8:
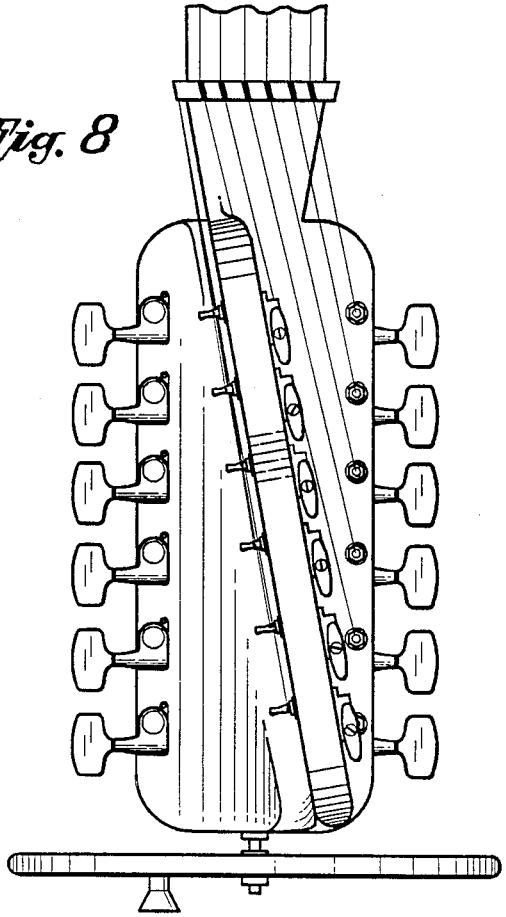
FIG. 8 shows an enlarged, fragmentary, right sided, elevational view of the head stock shown in FIG. 7.

DESCRIPTION OF THE PREFERED EMBODIMENTS a. The two neck embodiments of the R.P.G.S. is ½ of original four neck and pivots back and forth between disc and neck "A" and neck "B" with third side of triangle being smooth (no strings) as to simulate a natural guitar neck.

b. The 3 neck embodiments is ¾ of original handle and has a set of strings on all three sides of guitar triangle (note—two necks have natural guitar necks simulated on one side—three necks do not have simulated guitar necks on one side as the third set of strings takes that necks place).

c. The 4 necks is the original embodiment and is where the other two guitars came from and has four sets of strings on four sides and rotates between them by using your hand to turn to next side between pin mounted clear plastic discs.

d. The R.P.G.S. rotates from guitar (1 through 4) by pivoting between two clear plastic discs (FIG. A #1 and 2) that are attached to the top and bottom of said guitar as shown in FIG. A. The guitar straps (#3) fit to the two discs with normal guitar strap buttons or pins (#4 and 5) (to accomodate all normal guitar straps) and the player wears it over the shoulder in normal guitar playing position. #6 shows tuners for three guitars (mini size tuners) on four sided head stock (one side not exposed in drawing) #7 shows fret and fret board with standard size that is the exposed side of four sided guitar neck. #8 is the guitar body and #9 (A B C) A is the pick-up of exposed guitar, B is pick-up of left side guitar, and C is pick-up of right side of guitar (side view of B and C only). #10 is standard guitar bridge configuration. #11 is guitar base, and #12 is push-pull volume knobs and #13 is end pin jack with clear rotating disc mounted on it.

e. The R.P.G.S. guitar rotates between the plastic discs giving it easy access to four different guitars, in four different tunings on one multi-dimensional neck guitar plane.

f. The 24, 18, 12 (3 embodiments of R.P.G.S.) can all be used and played in acoustic form with no electronics and sound projection coming out the bottom of the guitar base or square bell.

Note:

No guitar before the R.P.G.S. has rotated from side to side.

The width of the round disc strap system keeps strap and rotation away from tuning heads of all four guitars.

Note:

Both 18 and 12 string prototypes exist and play well.

Note:

Guitar can be set up with steinberger TM bridges with no head stock and strung up from the top per steinberger guitar.

Note:

Guitar base or square bell on bottom of guitar has many embodiments: round or multi-bell configurations.

I claim:

1. A free wheeling rotating guitar comprising an elongated neck body having a plurality of faces and a first and second end;

a plurality of strings disposed across at least one of said plurality of faces and attached at said first and second ends of said elongated neck;

said elongated neck body includes two (2) discs for rotating said neck body therebetween;

one of said discs is rotatably attached to said first end of said elongated neck body by a first pen, the other with said discs is rotatably attached to said second end of said elongated neck body by a second pen;

each of said discs is attached to an end of a strap for holding said discs stationary with respect to said elongated neck body, whereby said elongated neck body may be rotated.

* * * * *